US006495731B1

(12) United States Patent
Cordier et al.

(10) Patent No.: US 6,495,731 B1
(45) Date of Patent: Dec. 17, 2002

(54) METHOD AND APPARATUS FOR REGULATING A STREAM OF GASEOUS FUEL

(75) Inventors: Remy Cordier, Sceaux (FR); Thierry Ferlin, Tinqueux (FR); Guy Tackels, Nanterre (FR); Thierry Mine, Annonay (FR)

(73) Assignee: Saint-Gobain Glass France, Courbevoie (FR)

( * ) Notice: Subject to any disclaimer, the term of this patent is extended or adjusted under 35 U.S.C. 154(b) by 0 days.

(21) Appl. No.: 09/489,838

(22) Filed: Jan. 24, 2000

(30) Foreign Application Priority Data

Jan. 22, 1999 (FR) ..... 9900680

(51) Int. Cl.[7] ..... C10L 3/00
(52) U.S. Cl. ..... 585/6; 585/14; 48/127.3
(58) Field of Search ..... 585/6, 14; 48/127.3

(56) References Cited

U.S. PATENT DOCUMENTS 2,547,970 A * 4/1951 Phillips ..... 48/127.3
4,390,346 A * 6/1983 Cramer et al. ..... 48/180 R
5,224,776 A * 7/1993 Clingman, Jr. et al. ..... 374/36
5,288,149 A * 2/1994 Meyer ..... 374/36
5,900,515 A * 5/1999 Mallinson et al. ..... 585/6
6,047,565 A * 4/2000 Moreau ..... 65/32.1
6,111,154 A * 8/2000 Mallinson et al. ..... 585/6

FOREIGN PATENT DOCUMENTS

| | | |
|---|---|---|
| DE | 1 234 160 | 2/1967 |
| EP | 0 075 369 | 3/1983 |
| EP | 0 518 269 | 12/1992 |
| JP | 58 6321 | 1/1983 |
| JP | 63-153315 | 6/1988 |
| JP | 5-71729 | 3/1993 |
| JP | 7-197053 | 8/1995 |

* cited by examiner

*Primary Examiner*—Jacqueline V. Howard
(74) *Attorney, Agent, or Firm*—Oblon, Spivak, McClelland, Maier & Neustadt, P.C.

(57) ABSTRACT

A method of regulating the calorific power of a stream of gaseous fuel of the fossil-gas type, comprising a predominant fuel gas, denoted "A" and flowing in a pipe. This regulation is performed, at least partly, by controlled addition of at least one fuel gas called having a calorific power greater than that of "A" into the stream. The subject of the invention is also its apparatus for implementation and its applications.

15 Claims, No Drawings

METHOD AND APPARATUS FOR REGULATING A STREAM OF GASEOUS FUEL

BACKGROUND OF THE INVENTION

1. Field of the Invention

The present invention relates to a method and an apparatus for the purpose of regulating the combustion characteristics of a gaseous fuel, and more particularly to the calorific power conveyed by a stream of gaseous fuel, especially a stream of fossil fuel of the natural-gas type.

The present invention relates especially to regulation of a stream of gaseous fuel distributed by a network of feed pipes to industrial plants using a thermal process, the regulation according to the invention preferably taking place at the downstream end of the said network, on the site of the industrial plant, or just upstream of the latter.

2. Description of the Background

The industrial plants more particularly intended are glass-making plants using natural-gas burners for melting (and possibly refining) glass in the widest sense, that is to say mineral compositions used to manufacture flatware (float lines), hollowware (plants for making bottles and flasks), mineral wool of a glass type or rook type intended for thermal and/or acoustic insulation, or glass fibers used for the reinforcement of polymeric-type materials, called reinforcing figures, or else textile fibers.

In all these types of plant, it is important for the furnaces to operate under the most constant and uniform conditions as possible, one parameter among others, which is not insignificant, being the properties of the fuel which feeds the burners, especially its calorific power. Now, it may happen that the distribution network delivers a natural gas whose properties fluctuate for various reasons, the most frequent of which is the fact that the network is fed with natural gas having different properties coming from several sources of supply.

It has therefore proved necessary to take corrective actions in order to compensate for these variations in calorific power.

A first mode of regulation has consisted in varying the flow of the fuel, by making a high-value correction to its calorific power by increasing its flow rate, or by making a low-value correction by decreasing its flow rate with a non-combustible gas in order to reduce its flow rate, the flow corrections taking place in the same proportions as the observed fluctuations in the calorific power of the fuel. This mode of regulation makes it possible to maintain the calorific flow entering the furnace at its set value. Whether this regulation is carried out manually or automatically, their limits have quickly been reached; this is because it has been observed that simply correcting the calorific power of the incoming gas by proportional modulation of the flow rate does not achieve perfect stabilization of the furnace operating conditions, all other things being equal. This could be explained by the fact that variations in the fuel flow rates at the burners also cause modifications in the manner in which the combustion takes place and, especially, the manner in which the flame will develop above the glass bath.

Accordingly, there remains a need for new methods of regulating the calorific power of fuel gases.

SUMMARY OF THE INVENTION

An object of the invention is to provide an improved mode of regulation for the calorific power of a stream of gaseous fuel, especially with the aim of minimizing any modification induced by the regulation itself in the manner in which the combustion takes place. In particular, an object of the invention is to achieve a regulation which preserves as far as possible the stability of the operating conditions of the furnace, when the fuel is intended to feed the burners of a furnace of the glass-furnace type.

Accordingly, the present invention provides a method of regulating the calorific power of a stream of gaseous fuel of the fossil-gas type comprising predominantly a gas, denoted "A", and flowing in a pipe. It consists in carrying out the regulation, at least partly, by the controlled addition of at least one combustible gas, denoted "B", having a calorific power greater than that of A into the stream.

A more complete appreciation of the invention and many of the attendant advantages thereof will be readily obtained as the same becomes better understood by reference to the following detailed description.

DETAILED DESCRIPTION OF THE INVENTION

As will be readily appreciated by those skilled in the art, the present invention may be used to regulate a wide variety of different combustible gas, for example of manufactured gases. In a preferred embodiment, the gas denoted the "A" is methane $CH_4$, composed predominantly of fossil gaseous fuel known as natural gas, which is therefore the stream of gaseous fuel to which the regulation according to the invention preferably applies.

In the context of the invention, the term "calorific power" refers to any parameter known in the field of combustible gas delivery for quantitatively assessing the thermal performance of the fuel during combustion. The calorific power may be the gross calorific value (GCV), well known in the field, which is expressed in kWh per standard $m^3$, which is related to the calorific power Pu by the equation $Pu=Q_C\times GCV$, where $Q_C$ is the standard volume f low rate of the fuel.

The calorific power may also be the C/H ratio of the fuel, having no units, which corresponds to the ratio of the total number of carbon atoms to the total number of hydrogen atoms of the fuel. For example, in the case of methane $CH_4$, this C/H ratio is ¼, i.e. 0.25. It may also be the Wobbe index W which may be related to the GCV by the equation:

$$W=GCV/(d)^{1/2},$$

where d is the density of fuel.

It is also conceivable to use the combustion air index a, which is defined by:

$$B=Va/(d)^{1/2},$$

where Va is the theoretical air needed for the combustion of 1 $m^3$ of fuel, B being a dimensionless quantity if Va is expressed in standard $m^3$ of air per standard $m^3$ of fuel.

It has in fact been verified that there is a good correlation in different ways of regulation, irrespective of the parameter chosen, with perhaps a preference for regulation using the Wobbe index which also takes into account the density variations of the gas, unlike the GCV.

The present invention therefore adopts a "high-value" regulation, that is to say one making it possible to control the calorific power of the fuel by adjusting it to higher values with the aid of a more "calorific gas" than the fuel, or more specifically more "calorific" than the predominant gas in the latter. This is because it is well known that, in the case of natural gas, the latter contains very predominantly a gas— methane—which generally represents more than 80% of the natural gas, the minor compounds being, for example, traces of inert gas, of the $N_2$ type, or of longer-chain hydrocarbons. Preferably, the regulation is performed with the aid of such a more calorific gas. The regulation does not modify, or only very little, the volume flow of the gas stream thus regulated.

This type of regulation affords many important advantages. The main advantage is that there is a marked improvement in the operating stir of the furnace fitted with burners fed with the fuel thus regulated. Although not to be limited to any specific theory, an explanation that may be put forward is that this mode of regulation makes it possible to control the incoming calorific flow without significantly modifying the volume flow and therefore without modifying the aeraulic properties of the flame (length, velocity, etc).

Another important and quite unexpected advantage relates to the emission of so-called NOx gases by furnaces whose burners are regulated in this manner; it has actually been observed that an upward regulation carried out as in the invention allowed the emission of NOx by furnaces to be significantly reduced, this being an extremely advantageous aspect for the environment.

Moreover, with such high-value regulation of the calorific power of the fuel, it is possible to reduce the specific energy consumption of the furnace, of the glassmaking-furnace type, which is expressed in a known manner in kilowatt-hours per tonne of glass. This energy saving constitutes a third significant advantage afforded by the invention, the more so as it makes it possible to significantly minimize the cost incurred by the regulation according to the invention, especially that of the injected propane-type "B" gas.

Preferably, the gas B is chosen from hydrocarbons having at least two carbon atoms, whether they are saturated or have at least one unsaturation. It may be a linear or branched hydrocarbon. Preferably, it contains from 2 to 6 carbon atoms and is especially in the form of propane or n-butane. In fact, it is preferable to choose a fuel in the form of a gas without addition treatment under the pressure and temperature conditions prevailing in the stream of fuel to be regulated. The cost of the chosen hydrocarbon and its availability also are taken into consideration.

B may more generally be a gas called a petroleum gas, that is to say one coming from the refining of petroleum, especially a gas based on propane or on n-butane; it being understood that these so-called petroleum gases, whether they have a predominant constituent, such as propane or butane, may also contain other, minor, components, for example propene, butene, etc., as is well-known.

In one embodiment, the regulation according to the invention preferably involves the following steps:

(a) measuring the calorific power CP of the stream of fuel, (b) comparing the measured calorific power CP with an upper set value $CP_{upper}$, (c) if necessary, an increase in the CP towards the $CP_{upper}$, value by adding a suitable amount of the "B" gas into the stream of fuel.

As will be readily appreciated, many alternative embodiments are possible. Thus, it is possible to choose to inject permanently at least a minimum flow of "B" gas into the stream of fuel or not, and therefore to regulate within addition of "B" in a flow rate range going from $Q_{min}$ (minimum flow rate) to $Q_{max}$ (maximum flow rate), where $Q_{min}$ is zero or a positive flow value.

According to a non-limiting mode of implementation, the regulation according to the invention may have the following characteristics:

Firstly, the method may comprise a so-called "rapid" loop which slaves the measured flow rate of the A+B mixture so that the amount of B gas injected remains proportional to the flow rate of an "A" gas, even should there be a sudden variation in the volume consumed (for example when the burners are started up or shut down). This automatic slaving may be achieved by a regulator whose setpoint is proportional to the mixture flow rate. For the sake of brevity, the expression "A+B mixture" should be understood to mean the mixture of the stream of fuel predominantly based on the "A" gas and of the stream of "B" gas with a greater calorific power, generally with a gas predominantly of the propane type, and optionally of other minority gases, even if the "A" gas is in fact the stream of fuel comprising entirely the predominant gaseous compound "A". Throughout the present text, A and B may thus be understood to mean, indiscriminately, single and specific gaseous compounds or streams of fuels containing these specific compounds plus other minority compounds.

The method of the invention may also comprise a so-called "slow" loop whose purpose is to increase the precision of the overall system for regulating the calorific power. This loop can automatically determine the setpoint of the so-called "rapid" loop (by means of a coefficient of proportionality) on the basis of the continuously measured deviation between the calorific power of the mixture and the chosen setpoint.

With regard to the measurement of the calorific power of the stream of fuel, two ways of doing this are preferred a direct measurement may be made, by using a measurement device of the "coburimeter" type which allows direct reading of the parameter which is continuously regulated. Such a device is described, for example, in EP-0 326 494 A1, incorporated herein by reference;

it is also possible to obtain the same information from the chemical analysis of the stream of fuel. In particular, it is possible to use a gas chromatography apparatus coupled to a computing means which will deduce, from the chemical analysis of the gas, its calorific power. The measurements may be made, for example, every three minutes.

It is preferable to adjust the calorific power as frequently as possible, while remaining dependent on the means that are available, especially those measuring the calorific power of the fuel.

Preferably, the response times of the above-mentioned loops are, for example, a few seconds in the case of the so-called rapids from 1 to 3 minutes in the case of the so-called "slow" loop if a "coburimeter" is used, and up to 5 to 15 minutes if a gas chromatograph is used. In order to give an order of magnitude, it may be stated that a measurement is obtained to within 1 to 2% using a "coburimeter" and a measurement to within 0.5 to 1% using a chromatograph. The chromatograph is therefore slightly more accurate, but does not allow continuous measurement. However, as it has been observed that in general the most rapid variations in the combustion properties of streams of fuel of the natural-gas type take place in less than 15 to 20 minutes, the use of a chromatograph therefore allows them to be taken into consideration without any problem.

Another aspect of the present invention is an apparatus for regulating the calorific power of a stream of gaseous fuel of the fossil-gas type comprising a so-called predominant gas "A" and flowing in a pipe, the apparatus comprising:

electronic/computing means for controlling the regulation;

at least one means for measuring the calorific power to be regulated, of the "coburimeter" type or by means of chemical analysis coupled to a suitable computing means;

at least one means of regulation for bringing the calorific power $CP_i$ of the stream to an upper setpoint value $CP_{upper}$ in the form of at least one means for injection of a modulated amount of a "B" gas having a calorific power greater than that of "A" into the stream. Advantageously, this apparatus makes it possible to implement the method described above.

Another aspect of the present invention is the application of the process and the apparatus described above to the regulation of the calorific power of a stream of fuel in a pipe located at the end or a feed network provided with one or more sources of supply, and more particularly of a stream of fuel in a pipe feeding one or more burners used in an industrial plant of the glassmaking-plant type with fuel.

Another aspect of the present invention is a glassmaking furnace itself, equipped with burners, at least some of which are fed with fuel regulated according to the invention.

The simplicity means that the regulation takes place in the main pipe feeding all the burners of the plant with fuel, nothing preventing, however, regulation in secondary pipes at each of the burners or only at some of them.

The invention will be described below in greater detail with the aid of a non-limiting embodiment which relates to a glassmaking furnace of the type of those used in the manufacture of flatware of the float type. This is, in a manner known per se, a furnace operating in inversion mode, equipped with two lateral regenerators and having substantially axial symmetry with respect to the longitudinal axis of the furnace in the distribution of the burners, which operate here using natural gas as fuel. For more details, see WO-98/02386, incorporated herein by reference.

However, the invention applies more generally to any type of glassmaking furnace using natural-gas burners, such as furnaces with so-called end-fired regenerators, the furnaces fox flatware operating without regenerators and generally using burners with the oxidizer in the form of oxygen (an example of which is described in EP-0,650,934, incorporated herein by reference). They may also be furnaces for the manufacture of hollowware, mineral wool or reinforcing fibers. The furnaces that may benefit from the invention may also use so-called "submerged" gas burners, that is to say burners configured so that the combustion flame or the gases coming from the combustion develop within the molten batch (an example being described in Pat. U.S. 3,260,587 and U.S. 3,738,792, incorporated herein by reference).

The actual design of the glassmaking burners is not limiting either, and is well-known by those skilled in the art.

Explained below, in a very schematic manner, is the way in which the regulation according to the invention is performed.

Starting from a furnace with lateral regenerators, two series of fuel injectors are therefore placed so as to face each other in the two side walls of the furnace. These injectors are fed via a main pipe with natural gas, located at the end of a national distribution network. The invention is used for regulating the Wobbe index (or the GCV) of the flow of natural gas in this pipe on the industrial site.

Specifically, the feed pipe of the furnace is tapped so as to be able to take a fuel sample at a given frequency in order to measure its properties (the Wobbe index or the GCV), either directly using a measuring device of the type described in EP-0,326,494 A1, cited above, or using a gas chromatograph. When a gas chromatograph is used, the optimum measurement frequency is every 3 minutes, thereby making it possible to react very quickly to any rapid fluctuation in the calorific power of the natural gas delivered and to check the effectiveness of the on-pipe regulation. Upstream of this tap needed for measuring the properties of the flow of fuel, a secondary pipe is provided for injecting propane, this secondary pipe being provided with a means for controlling the flow rate and being fed either by a propane distribution network or by a propane storage container. The propane is a commercial propane, coming from the refining of petroleum, and it may contain, for example, up to 10 to 20% of other minority compounds, generally other hydrocarbons such as propene.

Computing means control both the means of measuring the Wobbe index of the flow of natural gad and the means of controlling the propane flow rate: a maximum Wobbe index (or GCV) set value is imposed. The computing means, by comparing the measured Wobbe index (or the GCV) with the set value, continuously control the increase or decrease in the flow of propane injected into the main pipe so that the measurement is at the set value.

Economically, it is preferable to limit the amount of propane to be injected as far as possible, since its cost is markedly higher than that of natural gas. Thus, a high-value regulation is preferred, in which, apart from fluctuations, no propane is added to the stream of natural gas. It is therefore necessary to correctly calibrate the maximum set value as a function of the known range of variations in Wobbe index (or in GCV) (determination of a suitable "regulation window").

As mentioned above, in has been verified that stabilizing the Wobbe index (the same arguments being able to be applied to the GCV or to the C/H ratio, for example) in this way made it possible to better maintain the operating stability of the furnace. This is because, the calorific power of commercial propane being approximately 2.5 times greater than that of $CH_4$, which is the greatly predominant component of natural gas, the propane flow rates necessary for the regulation are low and have little disturbing effect on the stream of fuel.

Furthermore, it has also been possible to confirm that this type of regulation tends to reduce the NOx emissions of the furnace compared with standard ways of regulation consisting, for example, in diluting the natural gas with air or by increasing its flow rate, High-value regulation of the calorific power in the broad sense of the fuel is therefore favorable to conservation of the environment.

Finally, the regulation according to the invention allows the specific energy consumption of the furnace to be lowered; increasing the thermal efficiency of the furnace makes it possible to reduce the operating cost of it and thus to offset, at least partly, the additional cost due to propane injection.

Obviously, numerous modifications and variations of the present invention are possible in light of the above teachings. It is therefore to be understood that within the scope of the appended claims, the invention may be practiced otherwise than as specifically described herein.

This application is based on French Patent Application Serial No. FR99/00680, filed on Jan. 22, 1999, and incorporated herein by reference in its entirety.

What is claimed is:

1. A method of regulating the calorific power of a stream of gaseous fuel comprising a predominant fuel gas, A, and flowing in a pipe, comprising:

adding a controlled amount of at least one fuel gas, B, having a calorific power greater than A, into the stream, without significantly modifying the volume flow of the stream.

2. The method of claim 1, wherein A is methane.

3. The method of claim 1, wherein the stream of gaseous fuel is a natural gas.

4. The method of claim 1, wherein B is a hydrocarbon containing at least two C atoms, which is saturated or unsaturated, linear or branched.

5. The method of claim 4, wherein B contains 2 to 6 C atoms.

6. The method of claim 1, wherein B is propane.

7. The method of claim 1, wherein B is a petroleum gas.

8. The method of claim 1, which includes a regulation loop comprising the following steps:

(a) measuring the calorific power, $CP_i$, of the stream of fuel;

(b) comparing the measured calorific power $CP_i$ with an upper set value for the calorific power, $Cp_{upper}$; and (c) optionally, adding an amount of B to the stream of fuel to increase in the calorific power of the stream of fuel towards the $CP_{upper}$ value.

9. The method of claim 8, wherein the calorific power $CP_i$ of the gas stream is measured either directly by a measurement device of the coburimeter type or by calculation on the basis of its chemical analysis.

10. The method of claim 9, wherein calorific power $CP_i$ of the gas stream is measured by chromatography.

11. The method of claim 1, which includes a rapid loop which slaves the measured flow rate of the A+B mixture so that the amount of B added remains proportional to the flow rate of A with a regulator whose setpoint in proportional to the flow rate of the mixture, and a slow loop which determines the setpoint of the rapid loop on the basis of the measured deviation between the calorific power of the mixture and the chosen setpoint.

12. The method of claim 1, wherein the calorific power of a stream of fuel in a pipe located at the end of a feed network provided with one or more sources of supply is regulated.

13. The method of claim 1, wherein the calorific power of a stream of fuel in a pipe feeding burners used in an industrial plant of the glassmaking-plant type with fuel is regulated.

14. The method of claim 1, further comprising feeding the regulated stream of gas to a glassmaking furnace.

15. The method of claim 1, wherein the regulating is essentially performed by said adding a controlled amount of fuel gas B.

* * * * *